United States Patent [19]

Smith

[11] Patent Number: 4,534,714

[45] Date of Patent: Aug. 13, 1985

[54] FLUID OPERATING DEVICE

[76] Inventor: Raymond H. Smith, Rte. 2 - 5AAA, Larned, Kans. 67550

[21] Appl. No.: 637,520

[22] Filed: Aug. 3, 1984

Related U.S. Application Data

[63] Continuation-in-part of Ser. No. 466,667, Feb. 15, 1983, abandoned.

[51] Int. Cl.[3] ..... F04B 7/04; F04B 17/04; F16K 31/08; H02K 33/10

[52] U.S. Cl. ..... 417/416; 417/417; 417/505; 251/65; 310/32

[58] Field of Search ..... 310/23, 24, 32, 34, 310/35; 417/412, 413, 415–419, 467, 505, 521, 539; 251/65

[56] References Cited

U.S. PATENT DOCUMENTS

| | | | |
|---|---|---|---|
| 1,007,275 | 10/1911 | Desmond . | |
| 2,721,024 | 11/1955 | Zeh | 417/417 |
| 2,785,368 | 3/1957 | Moller | 251/65 |
| 3,274,985 | 9/1966 | Fowle et al. . | |
| 3,469,163 | 9/1969 | Mathews . | |
| 3,485,441 | 12/1969 | Eaton | 251/65 X |
| 3,910,729 | 10/1975 | Jepsen et al. | 417/417 |
| 4,150,925 | 4/1979 | Perkins | 417/418 |
| 4,421,464 | 12/1983 | Schmidt et al. | 417/412 |
| 4,434,968 | 3/1984 | Smith | 254/1 |

FOREIGN PATENT DOCUMENTS

| | | | |
|---|---|---|---|
| 2038949 | 7/1980 | United Kingdom | 417/417 |

*Primary Examiner*—Carlton R. Croyle
*Assistant Examiner*—Theodore Olds
*Attorney, Agent, or Firm*—Litman, Day and McMahon

[57] ABSTRACT

A fluid operating device including a cylinder assembly with a cylinder bore and a pair of pistons slidably disposed therein. A plurality of electromagnets are mounted on each piston in opposed relation and extend the pistons by magnetic repulsion when energized. Inlet and outlet valves are provided in the cylinder and include permanent magnet valve members which open and close the valves upon energization and de-energization of the electromagnets.

19 Claims, 4 Drawing Figures

FLUID OPERATING DEVICE

CROSS-REFERENCE TO RELATED APPLICATION

This is a continuation-in-part of U.S. patent application Ser. No. 466,667, filed Feb. 15, 1983 and now abandoned.

BACKGROUND OF THE INVENTION

1. Field of the Invention

The present invention relates generally to fluid operating devices and in particular to a pump or compressor which utilizes magentic repulsion for reciprocating pistons and actuating inlet and outlet valves.

2. Description of the Prior Art

Reciprocating pumps and compressors are well known in the art and a variety of different designs have been devised in an attempt to achieve maximum efficiency and reliability. various power sources and motors have heretofore been employed for reciprocating such devices.

In a typical reciprocating pump or compressor, inlet and outlet valves are provided for controlling the flow of fluid therethrough. A common type of valve which is usable for both suction and discharge is an automatic lift-type valve which is actuated by pressure differential. However, such valves generally reduce the efficiency of the pump or compressor somewhat because of a slight amount of backflow therethrough between the suction and discharge strokes. Heretofore there has not been available a reciprocating fluid controlling device with the advantages and features of the present invention.

SUMMARY OF THE INVENTION

In the practice of the present invention, a reciprocating fluid controlling device is provided which includes a cylinder with a pair of reciprocating pistons slidably disposed therein. Each piston has a plurality of electromagnets mounted thereon in opposing relation to the electromagnets of the other piston. The electromagnets are selectively energized to repulse each other and thus extend the pistons. The pistons are retracted by return springs. Inlet and outlet valves including permanent magnets are provided for controlling the flow of fluid through the cylinder and are actuated by the electromagnets of the pistons.

OBJECTS OF THE INVENTION

The objects of the present invention are: to provide a reciprocating pump or compressor; to provide such a pump or compressor which utilizes electromagnets for repulsing reciprocative pistons; to provide such a pump or compressor which utilizes Newton's third law to advantage; to provide such a pump or compressor with inlet and outlet valves including permanent magnets for interacting with electromagnets mounted on the pistons; and to provide such a pump or compressor which is efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE EMBODIMENT

Figure 2:
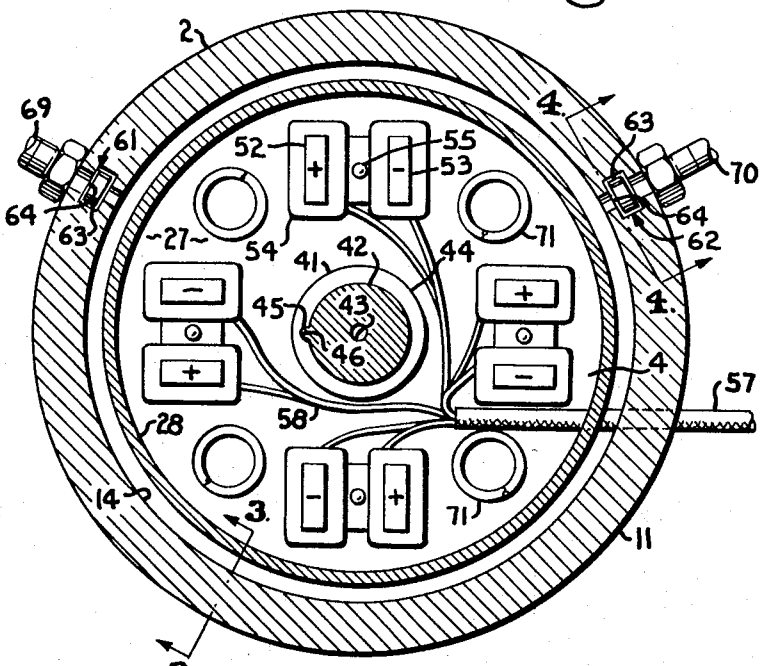
FIG. 2 is a horizontal cross section of the pump or compressor taken generally along line 2—2 of FIG. 1.
Figure 4:
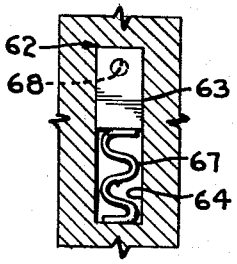
FIG. 4 is a fragmentary, vertical cross section of the pump or compressor particularly showing an outlet valve and taken generally along line 4—4 in FIG. 2.
Figure 3:
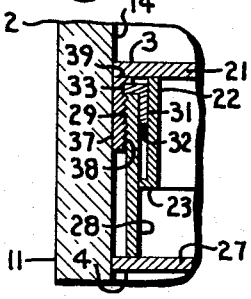
FIG. 3 is a fragmentary, vertical cross section of the pump or compressor particularly showing the interconnection between pistons thereof and taken generally along line 3—3 in FIG. 2.
Figure 1:
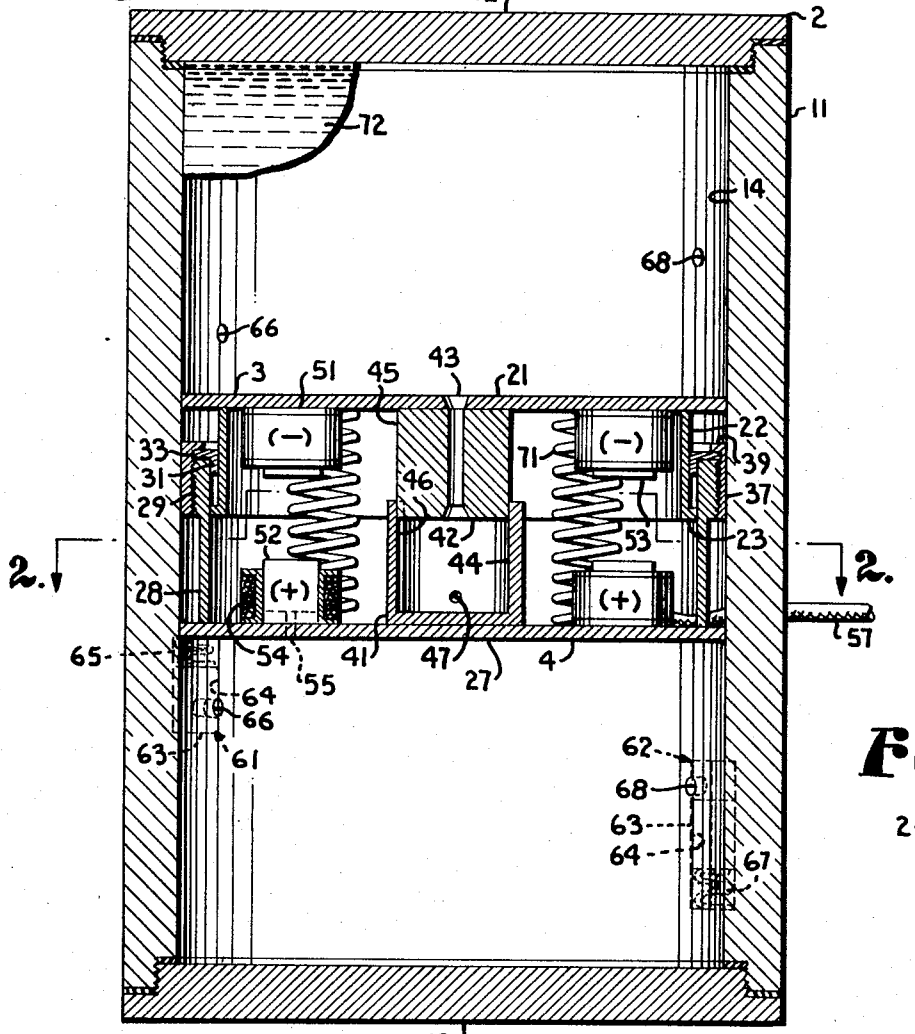
FIG. 1 is a vertical cross-section of a reciprocating pump or compressor comprising the present invention.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates a reciprocating fluid operating device comprising a pump or compressor embodying the present invention. The device 1 generally comprises a cylinder assembly 2 with first and second piston assemblies 3, 4 slidably disposed therein. The cylinder assembly 2 includes a cylinder wall 11 and first and second cylinder heads 12, 13 mounted on each end. A cylinder bore 14 is formed within the cylinder wall 11 and enclosed by the cylinder heads 12, 13.

The first piston assembly 3 comprises a circular plate 21 with a concentric, cylindrical skirt 22 extending inwardly therefrom and terminating at a flange 23. The skirt 22 is spaced inwardly from the cylinder wall 11.

The second piston assembly 4 includes a plate 27 and a concentric, cylindrical skirt 28 extending therefrom and terminating in an annular, male-threaded portion 29. A stop ring 31 is provided with an annular skirt 32 positioned concentric with and inside the second piston skirt 28 and an outwardly-extending, concentric flange 33 positioned over the end of the second piston threaded portion 29. An annular connecting sleeve 37 encircles the second piston threaded portion 29 and the annular stop flange 33. The sleeve 37 includes a female threaded portion 38 which threadably receives the second piston threaded portion 29 and a flange 39 for engaging the stop flange 33 and retaining the stop 31. The sleeve 37 slidably engages the cylinder wall 11 within the cylinder bore 14. Mechanical fasteners such as screws and the like (not shown) may be used for connecting the sleeve 37, the second piston thread portion 29 and the stop ring 31.

A dashpot 41 is provided for guiding and controlling the reciprocation of the piston assemblies 3, 4 with respect to each other and includes a plunger 42 mounted on the first piston plate 21 by a rivet 43, the plunger 42 being reciprocably received in a receiver 44 mounted on the second piston plate 27. The plunger 42 includes a longitudinally extending rib 45 slidably received in a longitudinally extending groove 46 in the receiver 44 for maintaining the piston assemblies 3, 4 in proper alignment with each other and preventing relative rotation therebetween.

A vent aperture 47 through the receiver 44 communicates its interior with the space between the piston assemblies 3, 4. The aperture 47 vents the receiver 44 to reduce the resistance of the dashpot 41 to reciprocation of the pistons 3, 4.

Mounted on each piston assembly 3, 4 are a plurality of U-shaped electromagnets 51 each having positive and negative poles 52, 53 and windings 54. As shown in FIG. 2, the electromagnets 51 are radially positioned at 90° intervals on the piston plates 21, 27. Each electromagnet 51 is secured to a respective plate 21, 27 by a rivet 55. The four electromagnets 51 mounted on each plate 21, 27 are positioned with their poles 52, 53 directly aligned with and in opposed relation to like poles 52, 53 of the four electromagnets 51 mounted on the other plate 21, 27.

An electrical cable 28 enters the pump or compressor 1 through the cylinder wall 11 and the second piston skirt 28 and includes a plurality of leads 58 each connected to a respective electromagnet winding 54.

Each end of the cylinder assembly 2 includes inlet and outlet valve assemblies 61, 62 having valve members 63 comprising permanent magnets slidably received in pockets 64. The inlet valve assemblies 61 are located in closer proximity to the piston assemblies 3, 4 than the outlet valve assemblies 62. The inlet valve assemblies 61 include springs 65 which retract respective valve members 63 to expose inlet ports 66. The outlet valve assemblies 62 include outlet compression springs 67 which urge respective valve members 63 over respective outlet ports 68. The inlet springs 65 are located on the inboard sides of respective pockets 64 and the outlet springs 67 are located on the outboard sides of respective pockets 64. The inlet and outlet ports 66, 68 communicate with respective inlet and outlet lines 69, 70.

In operation, electrical current from a current source (not shown) is intermittently supplied to the electromagnetic windings 54. Upon energization of the windings 54, magnetic fields emanate from the poles 52, 53 of the electromagnets 51 and since like poles of the electromagnets 51 on each piston assembly 3, 4 are aligned, magnetic repulsion urges the piston assemblies 3, 4 outwardly away from each other. The arrangement of the piston assemblies 3, 4 takes advantage of Newton's third law, which states that if two bodies interact, the force of one body on a second body is equal and opposite to the force of the second body on the first body. In other words, the piston assemblies 3, 4 are each forced outwardly with equal and opposite force from the magnetic repulsion between the electromagnets 51.

The valve members 63 are each oriented so that one end thereof is located in proximity to an electromagnet pole 52 or 53 having a like polarity. Thus, when the electromagnets 51 are energized, the valve members 63 are urged in an outward direction. Since energization of electromagnets 51 initiates extension strokes, the inlet valve assemblies 61 are closed and the outlet valve assemblies 62 are opened upon energization. However, since the outlet valve assemblies 62 are spaced slightly further from the piston assemblies 3, 4 than the inlet valve assemblies 61, opening of the outlet valve assemblies 61 occurs momentarily after the closing of the inlet valve assemblies 61. The valve assemblies 61, 62 are thus sequenced so that fluid pressure builds up within the cylinder bore 14 for a short time, preferably a fraction of a second, before it is released through the outlet valve assemblies 62.

Upon the piston assemblies 3, 4 reaching their fullest extensions, the current to the electromagnets 51 is cut and the magnetic fields generated thereby collapse. The piston assemblies 3, 4 are urged inwardly together by the return spring 71 and the inlet valve assemblies 61 open to allow the fluid 72 to be drawn into the cylinder bore 14. Deenergizing the electromagnets 51 also allows the outlet valve member 63 to move to their closed positions to prevent backflow through the outlet port 68.

The magnetic inlet and outlet valve assemblies 61, 62 are preferable to automatic lift-type valve assemblies which actuate under differential fluid pressure, because the magnetic valve assemblies may be timed and arranged so that they open and close before any significant backflow can occur therethrough.

Fluid 72 in the device 1 may comprise, for example, hydraulic fluid in which case the invention functions as a pump or a compressible gas in which case it functions as a compressor. The fluid 72 may be employed to perform work on a wide variety of extrensic apparatuses (not shown). Such apparatuses may include safety pressure relief valves to prevent damage thereto in the event of a fluid pressure surge from the pump or compressor 1.

It is to be understood that while certain forms of the present invention have been illustrated and described herein, it is not to be limited to the specific forms or arrangement of parts described and shown.

What is claimed and desired to be secured by Letters Patent is as follows:

1. A fluid operating device, which comprises:

(a) a cylinder including a cylinder bore;

(b) a piston slidably movable in said cylinder bore;

(c) a first electromagnet mounted on said piston;

(d) a second electromagnet positioned in said cylinder bore in opposed relation to said first electromagnet;

(e) mounting means for mounting said second electromagnet in said cylinder bore;

(f) said piston being adapted to move from a retracted position to an extended position upon energization of said electromagnets by a magnetic repulsion therebetween;

(g) a spring connected to said piston and said mounting means, said spring being adapted for returning said piston to its retracted position upon deenergization of said electromagnets;

(h) an inlet valve attached to said cylinder and adapted to admit fluid to said cylinder bore upon a retraction stroke of said piston, said inlet valve including a permanent magnet member adapted for opening said valve upon deenergization of said electromagnets; and (i) an outlet valve attached to said cylinder and adapted to release fluid from said cylinder bore upon an extension stroke of said piston, said outlet valve including a permanent magnet member adapted for opening said valve upon energization of said electromagnets.

2. The device according to claim 1, which includes:

(a) said piston having a circular plate slidably engaging said cylinder bore in close-fitting engagement therewith; and (b) said first electromagnet being mounted on said plate.

3. The device according to claim 1 wherein:

(a) said cylinder includes a cylinder wall having a pair of longitudinally-extending pockets; and (b) each said valve member is reciprocably positioned in a respective pocket.

4. The device according to claim 3, which includes:

(a) inlet and outlet ports extending through said inlet and outlet valve pockets respectively, said valve members being adapted to selectively close said ports.

5. The device according to claim 3 wherein:

(a) each said valve includes a return spring positioned in said pocket, said inlet valve return spring being adapted to open said inlet valve upon deenergization of said electromagnets and said outlet valve return spring being adapted to close said outlet valve upon de-energization of said electromagnets.

6. The device according to claim 1 wherein:

(a) said outlet valve is positioned further from said piston than said inlet valve.

7. The device according to claim 1 which includes:

(a) a dashpot connected to said piston and said second electromagnet mounting means.

8. The device according to claim 7 wherein said dashpot includes:

(a) a plunger mounted on one of said piston and second electromagnet mounting means;

(b) a receiver mounted on the other of said piston and said second electromagnet mounting means;

(c) one of said piston and said receiver having a longitudinally-extending rib; and (d) the other of said plunger and said receiver having a longitudinally-extending groove slidably receiving said rib.

9. The device according to claim 8 wherein:

(a) said receiver includes a vent aperture.

10. The device according to claim 1, which includes:

(a) an electrical cable extending into said cylinder and having leads connected to said electromagnets.

11. A fluid operating device, which comprises:

(a) a cylinder assembly including:

(1) a cylinder wall enclosing a cylinder bore;

(2) first and second ends;

(3) first and second cylinder heads mounted on said cylinder first and second ends respectively;

(b) first and second pistons slidably movable in said cylinder bore;

(c) first and second aligned electromagnets mounted on said first and second pistons respectively;

(d) said pistons being adapted to move from retracted to extended positions upon energization of said electromagnets by a magnetic repulsion therebetween;

(e) return means connected to said pistons and adapted for returning said pistons to their retracted positions upon deenergization of said electromagnets;

(f) a pair of inlet valves each mounted in a respective cylinder end and adapted to admit fluid to said cylinder bore upon retraction stroke of a respective piston, said inlet valves including permanent magnet members adapted for closing said valves upon energization of said electromagnets; and (g) a pair of outlet valves each mounted in a respective cylinder end and adapted for releasing fluid from said cylinder bore upon an extension stroke of a respective piston, said outlet valves including permanent magnet members adapted for opening said outlet valves upon energization of said electromagnets.

12. The device according to claim 11, which includes:

(a) each said piston having a circular plate slidably engaging said cylinder bore in close-fitting engagement therewith; and (b) said electromagnets being mounted on said plates.

13. The device according to claim 11 wherein:

(a) each said valve includes a longitudinally-extending pocket; and (b) each said valve member is reciprocably positioned in a respective pocket.

14. The device according to claim 13, which includes:

(a) inlet and outlet ports extending through said inlet and outlet valve pockets respectively, said valve members being adapted to selectively close said ports.

15. The device according to claim 13 wherein:

(a) each said valve includes a return spring positioned in said pocket, said inlet valve return springs being adapted to open said inlet valves upon deenergization of said electromagnets and said outlet valve return springs being adapted to close said outlet valves upon de-energization of said electromagnets.

16. The device according to claim 11 wherein:

(a) said outlet valves are positioned further from said piston than said inlet valves.

17. The device according to claim 11 which includes:

(a) a dashpot connected to said pistons.

18. The device according to claim 17 wherein said dashpot includes:

(a) a plunger mounted on one of said pistons;

(b) a receiver mounted on the other of said pistons said second electromagnet mounting means;

(c) one of said piston and said receiver having a longitudinally-extending rib; and (d) the other of said plunger and said receiver having a longitudinally-extending groove slidably receiving said rib.

19. A fluid operating device, which comprises:

(a) a cylinder assembly including:

(1) a cylinder wall enclosing a cylinder bore;

(2) first and second ends;

(3) first and second cylinder heads mounted on said cylinder first and second ends respectively;

(b) a first piston assembly including:

(1) a circular plate positioned in said cylinder bore in close-fitting engagement therewith;

(2) a skirt extending coaxially in an inboard direction from said plate and terminating in an annular flange in spaced relation inwardly from said cylinder wall;

(c) a second piston assembly including:

(1) a circular plate positioned in said cylinder bore in close-fitting engagement therewith;

(2) a skirt extending coaxially in an inboard direction from said plate and terminating in an annular threaded portion;

(d) an annular stop member positioned inside of and concentric with said threaded portion of said second piston assembly skirt, said stop member having an outwardly-extending flange;

(e) an annular sleeve having internal threads adapted for threadably receiving said threaded portion of said second piston assembly skirt and a flange adapted for retaining said stop, said sleeve being slidably received in said cylinder bore;

(g) a dashpot including:

(1) a plunger mounted on one said piston assembly coaxially therewith;

(2) a receiver mounted on the other said piston assembly coaxially therewith, said receiver being adapted to slidably receive said plunger;

(3) a rib extending longitudinally along one of said plunger and said receiver;

(4) a groove extending longitudinally along the other of said plunger and said receiver, said rib being slidably received in said groove whereby relative rotation between said piston assemblies is prevented;

(h) a plurality of electromagnets mounted on each said piston assembly, each said electromagnet including a U-shaped core with poles having opposite polarity and windings on each said pole, said electromagnets on one said piston assembly being mounted with like poles in opposing relation to electromagnets on the other said piston assembly;

(i) an electrical cable extending into said cylinder between said piston assemblies, said electrical cable including a plurality of leads each extending to a respective electromagnetic winding;

(j) an inlet valve assembly including:

(1) a pocket in said cylinder wall and extending longitudinally therewith;

(2) an inlet valve member comprising a permanent magnet slidably received in said pocket;

(3) an inlet port in said cylinder wall extending through said pocket and adapted for admitting fluid to said cylinder bore, said inlet port being selectively closed by said inlet valve member;

(4) a return spring positioned in said pocket and adapted for urging said inlet valve member to an open position with said inlet port uncovered;

(k) an outlet valve assembly including:

(1) a pocket in said cylinder wall and extending longitudinally therewith;

(2) an outlet valve member comprising a permanent magnet slidably received in said pocket;

(3) an outlet port in said cylinder wall extending cylinder wall through said pocket and adapted for releasing fluid from said cylinder bore, said outlet port being selectively closed by said valve member; and (4) a return spring positioned in said pocket and adapted for urging said outlet valve member to a closed position with said outlet port covered.

* * * * *